US008322569B2

(12) United States Patent
Udischas et al.

(10) Patent No.: US 8,322,569 B2
(45) Date of Patent: Dec. 4, 2012

(54) INTEGRATED VALVE REGULATOR ASSEMBLY AND SYSTEM FOR THE CONTROLLED STORAGE AND DISPENSING OF A HAZARDOUS MATERIAL

(75) Inventors: Richard J. Udischas, Newark, DE (US); Denis Muller, Duesseldorf (DE); Werner Schleser, St. Marcel (FR)

(73) Assignees: L'Air Liquide Societe Anonyme pour l'Etude et l'Exploitation des Procedes Georges Claude, Paris (FR); American Air Liquide, Inc., Fremont, CA (US)

( * ) Notice: Subject to any disclaimer, the term of this patent is extended or adjusted under 35 U.S.C. 154(b) by 882 days.

(21) Appl. No.: 12/328,377

(22) Filed: Dec. 4, 2008

(65) Prior Publication Data

US 2009/0145494 A1 Jun. 11, 2009

Related U.S. Application Data

(60) Provisional application No. 60/992,967, filed on Dec. 6, 2007.

(51) Int. Cl.
*B67D 7/00* (2010.01)

(52) U.S. Cl. ..... 222/3; 222/153.03; 222/153.11; 222/189.1; 222/400.7; 222/464.2; 222/396; 137/505

(58) Field of Classification Search ..... 222/3, 189.1, 222/153.03, 153.11, 153.14, 394, 396, 400.7, 222/464.1, 464.2, 55, 153.13, 189.06; 137/505, 137/509, 510; 141/2–4, 18, 21
See application file for complete search history.

(56) References Cited

U.S. PATENT DOCUMENTS 1,854,352 A * 4/1932 Rosswell ..... 222/3
(Continued)

FOREIGN PATENT DOCUMENTS

EP 1 367 316 A2 12/2003
(Continued)

OTHER PUBLICATIONS

Written Opinion for co-pending PCT/US2008/085525.
(Continued)

*Primary Examiner* — J. Casimer Jacyna
(74) *Attorney, Agent, or Firm* — Patricia E. McQueeney

(57) ABSTRACT

The present invention provides for an integrated valve regulator assembly that comprises an integral body having a base portion that includes an axis for mounting on and coaxially with the neck portion of a pressurized source vessel and an assembly outlet, a defined internal passage in the integral body that extends through and between the base portion of the integral body and the assembly outlet, a sub-atmospheric pressure regulator assembled within the integral body of the integrated valve regulator assembly, an isolation valve positioned within the defined internal passage of the integral body and located downstream from and in communication with the sub-atmospheric pressure regulator, and a filling port disposed between the axis for mounting on and coaxially with the neck portion of the pressurized source vessel and the sub-atmospheric pressure regulator. The present invention further provides for a system for the controlled storage and dispensing of a hazardous material at sub-atmospheric pressure that comprises a pressurized source vessel and the integrated valve regulator assembly of the present invention. The present invention further provides for an additional integrated valve regulator assembly as described with the exception that the pressure regulator utilized is for super-atmospheric pressure conditions and also a system that comprises a pressurized source vessel and the integrated valve regulator assembly that includes a super-atmospheric pressure regulator.

16 Claims, 6 Drawing Sheets

U.S. PATENT DOCUMENTS

| | | | | | |
|---|---|---|---|---|---|
| 5,105,996 | A | * | 4/1992 | Freeland et al. | 222/464.1 |
| 5,518,528 | A | | 5/1996 | Tom et al. | |
| 5,566,713 | A | * | 10/1996 | Lhomer et al. | 137/613 |
| 5,707,424 | A | | 1/1998 | Tom et al. | |
| 5,935,305 | A | | 8/1999 | Tom et al. | |
| 5,937,895 | A | | 8/1999 | Le Febre et al. | |
| 5,975,121 | A | | 11/1999 | Arzenton et al. | |
| 6,029,694 | A | * | 2/2000 | Schwegler et al. | 137/510 |
| 6,089,027 | A | | 7/2000 | Wang et al. | |
| 6,101,816 | A | | 8/2000 | Wang et al. | |
| 6,257,000 | B1 | | 7/2001 | Wang | |
| 6,314,986 | B1 | | 11/2001 | Zheng et al. | |
| 6,343,476 | B1 | | 2/2002 | Wang et al. | |
| 6,360,546 | B1 | | 3/2002 | Wang et al. | |
| 6,474,076 | B2 | | 11/2002 | Wang et al. | |
| 6,527,009 | B2 | | 3/2003 | Zheng et al. | |
| 6,620,256 | B1 | | 9/2003 | Arno et al. | |
| 6,648,021 | B2 | | 11/2003 | Zheng et al. | |
| 6,857,447 | B2 | | 2/2005 | Olander et al. | |
| 6,910,602 | B2 | | 6/2005 | Hasaka et al. | |
| 6,959,724 | B2 | | 11/2005 | Heiderman | |
| 6,997,202 | B2 | | 2/2006 | Olander | |
| 7,013,916 | B1 | | 3/2006 | Pearlstein et al. | |
| 7,150,299 | B2 | | 12/2006 | Hertzler et al. | |
| 7,168,445 | B2 | | 1/2007 | Downie | |
| 7,172,646 | B2 | | 2/2007 | Tempel et al. | |
| 7,284,564 | B2 | | 10/2007 | Olander | |
| 2005/0016186 | A1 | | 1/2005 | Tom | |
| 2006/0137748 | A1 | | 6/2006 | Cannet et al. | |

FOREIGN PATENT DOCUMENTS

| | | | |
|---|---|---|---|
| EP | 1 515 080 | A2 | 3/2005 |
| EP | 1 855 048 | A1 | 11/2007 |
| WO | WO 2004 065750 | A2 | 8/2004 |
| WO | WO 2009 079218 | A2 | 6/2009 |
| WO | WO 2009 079218 | A3 | 6/2009 |

OTHER PUBLICATIONS

International Search Report for PCT/US2008/085525 & Written Opinion.

* cited by examiner

INTEGRATED VALVE REGULATOR ASSEMBLY AND SYSTEM FOR THE CONTROLLED STORAGE AND DISPENSING OF A HAZARDOUS MATERIAL

CROSS-REFERENCE TO RELATED APPLICATIONS

This application claims the benefit of U.S. Provisional Application No. 60/992,967, filed Dec. 6, 2007, the entire contents of which are incorporated herein by reference.

FIELD OF THE INVENTION

The present invention relates to an improved integrated valve regulator assembly for use in the pressurized storage and dispensing of hazardous materials. The present invention further relates to a system for storing hazardous materials in the form of compressed gases or liquefied gases and the dispensing of these hazardous materials as gases which system includes the improved integrated valve regulator assembly and a pressurized gas storage vessel.

BACKGROUND

Regulators and gas dispensing equipment are typically used for bringing a gas from its transport or storage pressure to its service pressure and then dispensing the gas at this service pressure. Not only is it important that such gases be dispensed precisely or that the purity of such gases be accurately preserved, in the case where such gases are considered to be hazardous or toxic to the operator of the system, it is also important that the operator be protected from exposure to such gases. More specifically, in areas such as the manufacture of electronics, photovoltaic solar cells, flat panel display manufacture, LED manufacture, laboratory analysis and the like, materials that are utilized often qualify as hazardous materials since contact with these materials would be considered to be harmful and/or dangerous to the operator of such a system. It is therefore important to be able to provide a safe and effective manner for operators to handle such hazardous materials at either super-atmospheric pressures or sub-atmospheric pressures to minimize the possible dangers to operators.

A number of systems are currently available for the storage and dispensing of hazardous gases at sub-atmospheric pressures but each of these has their own drawbacks. More specifically, there are systems which seek to minimize the hazards by placing the dispensing means inside the gas cylinder. Such systems hold less product and cannot hold liquefied products. In addition, such systems present problems when such cylinders are placed on their side. Other systems exist which utilize adsorbents for the storage of the hazardous gases. However, these systems are also limited in their capacity due to the inclusion of adsorbents, the capacity limitation of the absorbent for the molecule to be adsorbed, desorption due to exposure to temperatures higher than indoor temperatures and issues with purity. Other apparatus include the mechanical means within the pressurized vessel. However, in these apparatus, the mechanical means take up space within the vessel limiting the volume for the gas in an already small vessel (those having a capacity of 2.5 liter volume). In addition, with regard to holding liquefied gases, there is the additional issue of the mechanical means coming into contact with the liquefied gases.

Accordingly, there exists a need for a regulator assembly which minimizes dangerous risks often associated with the storage and dispensing of hazardous materials while at the same time not foregoing storage capacity and ease of dispensing.

SUMMARY OF THE INVENTION

The present invention provides for an integrated valve regulator assembly that comprises an integral body having a base portion that includes an axis for mounting on and coaxially with the neck portion of a pressurized source vessel and an assembly outlet, a defined internal passage in the integral body that extends through and between the base portion of the integral body and the assembly outlet, a sub-atmospheric pressure regulator assembled within the integral body of the integrated valve regulator assembly, an isolation valve positioned within the defined internal passage of the integral body and located downstream from and in communication with the sub-atmospheric pressure regulator, and a filling port disposed between the axis for mounting on and coaxially with the neck portion of the pressurized source vessel and the sub-atmospheric pressure regulator. The present invention further provides for a system for the controlled storage and dispensing of a hazardous material at sub-atmospheric pressure that comprises a pressurized source vessel and the integrated valve regulator assembly of the present invention. The present invention further provides for an additional integrated valve regulator assembly as described with the exception that the pressure regulator utilized is for super-atmospheric pressure conditions and also a system that comprises a pressurized source vessel and the integrated valve regulator assembly that includes a super-atmospheric pressure regulator.

DETAILED DESCRIPTION OF THE INVENTION

Figure 1:
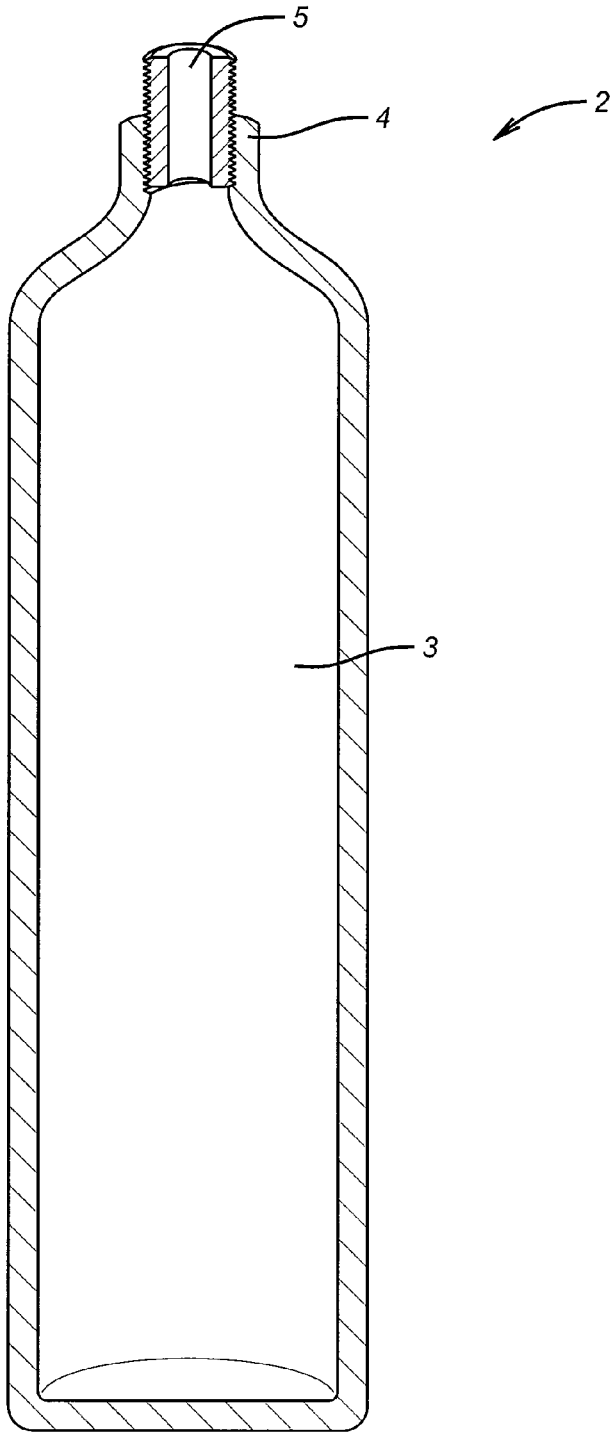
FIG. 1 provides a cut away of one embodiment of the pressurized source vessel of the present invention.

The present invention provides an integrated valve regulator assembly for use in a system for the controlled storage and dispensing of a hazardous material at either super-atmospheric pressure or sub-atmospheric pressure. The system comprises at least a pressurized source vessel and the integrated valve regulator assembly of the present invention. Systems such as those of the present invention are often used in industrial processes and applications, including areas such as semiconductors manufacturing, to supply hazardous materials to downstream systems. The present system is contemplated to supply a hazardous material directly to a downstream system (including having the system directly in the room where the downstream system is being utilized) or to supply a hazardous material to a manifold which will then supply the hazardous material to one or more downstream systems. As used herein, the phrase "hazardous material(s)" refers to any material which because of its corrosive or toxic nature may cause temporary or permanent damage or harm to a person who comes in contact with the hazardous material. One of the objectives of the present invention is to minimize the dangerous risks associated with the storage and dispensing of hazardous materials for the operators that are working either directly or indirectly with such systems as those described herein. Examples of materials which are considered to be hazardous materials within the scope of the present invention include, but are not limited to, $PH_3$, $BF_3$, $AsH_3$, $GeH_4$, $H_2Se$, COS, TMB (trimethyl boron), $GeF_4$, $AsF_5$, $SiH_4$, $NF_3$ and $PF_3$. From within this group of noted hazardous materials, in general, when the system utilized includes a sub-atmospheric pressure regulator, non-limiting examples of the hazardous material(s) contemplated to be stored and dispensed will typically be $PH_3$, $BF_3$, $AsH_3$. In general, when the system utilized includes a super-atmospheric pressure regulator, non-limiting examples of the hazardous material(s) contemplated to be stored and dispensed will typically be $GeH_4$, $H_2Se$, COS, TMB (trimethyl boron), $GeF_4$, $AsF_5$, $SiH_4$, $NF_3$ and $PF_3$. Those of ordinary skill in the art will recognize that these groupings (for sub-atmospheric pressure regulators and super-atmospheric regulators) are not meant to be limited and are instead illustrative of the types of hazardous materials typically utilized under such pressure conditions. In addition, the hazardous materials are not meant to be a limiting factor with regard to the present invention and accordingly may comprise any hazardous material which meets the above noted definition.

The system of the present invention comprises a pressurized source vessel having mounted thereon an integrated valve regulator assembly that is a pressure regulator/valve assembly. The pressurized source vessel can be any cylinder or other appropriate container that is typically utilized for storing and supplying the hazardous materials as described herein provided that the vessel has a neck portion and an interior space for holding a hazardous material in either a liquefied gas form or a compressed gas form and further that the neck portion has a vessel outlet that traverses the neck portion and is in communication with the interior space through which the hazardous material can flow. The vessel outlet serves as an outlet for the flow of the hazardous material. The pressurized source vessel can be made of any material that is not susceptible to the effects of coming in contact with the hazardous material stored therein and must have the ability to withstand high degrees of pressure. Typically such vessels will be made of carbon steel, aluminum or stainless steel although those of ordinary skill in the art will recognize that other types of materials may be used to make these vessels.

As noted, the integrated valve regulator assembly of the present invention is for use with a pressurized source vessel. The integrated valve regulator assembly includes an integral body, an assembly outlet, a defined internal passage, a pressure regulator, an isolation valve and a filling port. The internal body of the integrated valve regulator assembly is basically the housing for the system. The integral body has a base portion that includes an axis for mounting on and coaxially with the neck portion of the pressurized source vessel. The mounting is made in such a way that when the conditions are such as to allow the flow of hazardous material from the pressurized source vessel, the hazardous material flows through the vessel outlet of the neck portion of the pressurized source vessel and into the integrated valve regulator assembly where it is further distributed. The base portion may be mounted to the pressurized source vessel in any number of manners including but not limited to being threadably mounted at a specific torc setting as those of ordinary skill in the art will recognize in order to provide a leakproof seal or by any other method known to those of ordinary skill in the art. Regardless of the means utilized to mount the base portion of the integral body to the neck portion of the pressurized source vessel, it is important to make certain that the mounting is secure and thoroughly sealed in order to prevent leakage of the hazardous material when the hazardous material flows from the pressurized source vessel and into the integrated valve regulator assembly. While the integral body may be any type of material which is not susceptible to the effects of coming in contact with the hazardous materials, the preferred material for making the integral body is stainless steel, nickel or monel.

The integrated valve regulator assembly also includes an assembly outlet which serves as the point where the hazardous material will exit the integrated valve regulator assembly under specific conditions as further defined herein. This assembly outlet also serves as the point of connection to and between a specific system or a manifold that is capable of sending hazardous material further downstream to one or more downstream systems. The assembly outlet may include a locking mechanism which prevents the inadvertent opening of the assembly outlet and serves as a safety measure when the system is not connected to a downstream system. The locking mechanism may comprise any mechanism which "locks" the outlet until it is connected to a downstream system. Typically this locking mechanism will comprise a plug which is placed in the opening of the outlet and a cap that is locked into place and requires the use of a cap key to remove the cap.

The integral body of the gas delivery system further includes a defined internal passage in the integral body. This defined internal passage is a single path or passageway that extends through the integral body between the base portion of the integral body and the assembly outlet. The upstream portion of the defined internal passage is in communication with the vessel outlet of the pressurized source vessel and therefore also serves as the assembly inlet for receiving the hazardous material from the pressurized source vessel. In other words, hazardous material will flow through the vessel outlet of the pressurized source vessel into the upstream portion of the defined internal passage where it will then continue to flow through the defined passageway of the defined internal passage.

In one embodiment of the present invention, the integrated valve regulator assembly also includes a sub-atmospheric pressure regulator within the integral body of the integrated valve regulator assembly. The sub-atmospheric pressure regulator lies along the passageway of the defined internal passage with the integral body forming the actual housing of the sub-atmospheric pressure regulator which contains the means for providing sub-atmospheric pressure. As used herein, the phrase "sub-atmospheric" refers to a pressure that is less than one atmosphere. Furthermore, with regard to this particular embodiment, the means for providing sub-atmospheric pressure comprises a poppet and diaphragm which respond by remaining closed unless downstream is at less than one atmosphere in which case the means opens and allows hazardous material to flow therethrough. The means for providing sub-atmospheric pressure may further comprise an additional safety in the form of two sets of seal rings to allow for double leak tightness in the event that one or more of the other components of the means for providing sub-atmospheric pressure fail. The sub-atmospheric pressure regulator of the present invention does not contain one set point but instead responds to pressure over a range with this response depending upon the pressure in the source vessel and the pressure applied to the system via the assembly outlet. Accordingly, with regard to the present invention when a sub-atmospheric pressure regulator is utilized, the hazardous material will flow through the sub-atmospheric pressure regulator at a pressure that typically ranges from about 50 Torr to about 600 Torr, depending upon the pressure in the pressurized source vessel and the pressure to be applied to the assembly outlet. As noted, the corresponding means for responding to pressure is disposed within the defined internal passage and allows for the passage of hazardous material in gas form when the means for providing sub-atmospheric pressure senses a sub-atmospheric pressure downstream of the sub-atmospheric pressure regulator.

In a still further embodiment of the present invention, the integrated valve regulator assembly will alternatively include a super-atmospheric pressure regulator within the integral body of the integrated valve regulator assembly. Accordingly, the pressure regulator will be a super-atmospheric pressure regulator. As used herein, the phrase "super-atmospheric" refers to a pressure that is greater than one atmosphere. Furthermore, with regard to this particular embodiment, the means for providing super-atmospheric pressure comprises a poppet and diaphragm which respond to pressure by opening and allowing hazardous material to flow therethrough but remain closed when the pressure is not greater than one atmosphere. The means for responding to super-atmospheric pressure may further comprise an additional safety in the form of two sets of seal rings to allow for double leak tightness in the event that one or more of the other components of the means for responding to sub-atmospheric pressure fail. The super-atmospheric pressure regulator of the present invention does not contain one set point but instead responds to pressure over a range with this response depending upon the pressure in the source vessel and the pressure applied to the system via the assembly outlet. The integrated valve regulator assembly further includes an isolation valve positioned within the defined internal passage of the integral body of the integrated valve regulator assembly and located downstream from and in communication with the sub-atmospheric pressure regulator (or in the alternative embodiment, the super-atmospheric pressure regulator). The function of the isolation valve is to allow for the flow of hazardous material in gas form from the sub-atmospheric pressure regulator (or super-atmospheric pressure regulator) and through the isolation valve when the isolation valve is in an opened position. Alternatively, the isolation valves serves to block the flow of hazardous material in the gas form when the isolation valve is in a closed position. The isolation valve is connected downstream to the assembly outlet and therefore once the hazardous material flows through the isolation valve, it will exit the integrated valve regulator assembly and flow further downstream to its point of use. The isolation valve can be operated manually utilizing a handwheel or may be operated utilizing an automatic actuator such as those readily known in the art.

The integrated valve regulator assembly still further comprises a filling port that is disposed between the axis for mounting on and coaxially with the neck portion of the pressurized source vessel and the sub-atmospheric pressure regulator (or in the alternative embodiment, the super-atmospheric pressure regulator). The filling port includes a site of injection. This site of injection serves to allow for the direct injection of hazardous material into the defined internal passage of the integral body. The site of injection has an associated filling valve which has an open position and a closed position and allows for the injection of hazardous material into the pressurized source vessel when the filling valve is in the opened position. As noted, the filling port will serve as the site for injecting the hazardous material. Note that hazardous material will be injected prior to the withdrawal of the hazardous material for use downstream. When the gas delivery system is in use for dispensing hazardous material to a downstream system, the filling port will not be in use. This is further ensured through the use of a variety of plugs and caps to secure the site of injection of the filling port and the associated filling valve. More specifically, the filling port may further comprise a safety plug that is positioned within the site of injection of the filling port and a safety cap that is positioned on the exterior of the filling port with each requiring removal prior to the filling valve being opened to allow for the injection of hazardous material into the pressurized source vessel. Once the hazardous material has been injected into the pressurized source vessel, the safety plug and safety cap is replaced and the filling valve is closed in order to secure the filling port. Optionally, as a further safety precaution, the safety plug and safety cap may each require a separate key to remove the safety plug and safety cap. Furthermore, the filling valve may include a locking mechanism for when the filling valve is not in use. The filling valve may be operated (opened or closed) utilizing either a handwheel or an automatic actuator of the type known in the art. The handwheel is removed and a cap is placed over the position of the handwheel. The cap requires a special key to remove it in order to put the handwheel in position to open the filling valve.

With regard to the system for the controlled storage and dispensing of a hazardous material, in the embodiment where a sub-atmospheric pressure regulator is used, when a downstream system under vacuum is connected to the integrated valve regulator assembly of the system via the assembly outlet and the isolation valve is placed in the opened position, hazardous material in gas form flows from the interior space of the pressurized source vessel through the vessel outlet, into the upstream portion of the defined internal passage, along the defined internal passage through the sub-atmospheric pressure regulator and isolation valve and out the assembly outlet where the hazardous material in gas form is delivered to the point of use at sub-atmospheric pressure either directly or though a manifold.

With regard to the system for the controlled storage and dispensing of a hazardous material, in the embodiment where a super-atmospheric pressure regulator is used, when a downstream system having a pressure greater than one atmosphere is connected to the integrated valve regulator assembly of the system via the assembly outlet and the isolation valve is placed in the opened position, hazardous material in gas form flows from the interior space of the pressurized source vessel through the vessel outlet, into the upstream portion of the defined internal passage, along the defined internal passage through the super-atmospheric pressure regulator and isolation valve and out the assembly outlet where the hazardous material in gas form is delivered to the point of use at super-atmospheric pressure either directly or though a manifold.

A still further embodiment of the present invention involves the use of a vapor dip tube (also commonly referred to as a eductor) in order to provide an added safety measure for those instances where the hazardous materials being stored are present in both the liquefied gas form and the compressed gas or vapor form. The vapor dip tube prevents the flow of hazardous material in the liquefied gas form into the integrated valve regulator assembly in instances where the pressurized source vessel either falls over, gets knocked over or is positioned on its side. As used herein, the phrase "liquefied gas form" used in reference to hazardous materials, refers to a hazardous material which under pressure is typically in a liquefied form but may also include gas/vapor form of the hazardous material. Non-limiting examples of such hazardous materials which are present in liquefied gas form under pressure include $PH_3$, $AsH_3$, $GeH_4$, $H_2Se$, COS, TMB, $GeF_4$, and $AsF_5$. The vapor dip tube of the present invention includes a fritted end. Preferably, the fritted end of the vapor dip tube has a sintered metal element. The sintered metal element can be stainless steel, nickel, monel or like materials. Typically, the sintered metal element has a pore size equivalent from about 10 to about 200 μm, preferably from about 10 μm to about 50 μm.

When the vapor dip tube is present, it is connected to the upstream portion of the defined internal passage. The vapor dip tube is configured to extend from the upstream portion of the defined internal passage into the interior space of the pressurized source vessel when the base portion of the integral body is mounted on and coaxially with the neck portion of the pressurized source vessel, thereby providing communication between the defined internal passage and the interior space of the pressurized source vessel while at the same time preventing hazardous material in liquefied gas form from exiting the pressurized source vessel.

The vapor dip tube extends down into the pressurized source vessel and has a curvature that is considered to be outward and in the same direction of the location of the assembly outlet. This curve is therefore considered to be an outward bend pointing in the same direction as the assembly outlet. When the pressurized source vessel is in a horizontal position, the vapor dip tube is pointed up thereby preventing hazardous material in the liquefied gas form from flowing to the assembly outlet of the integrated valve regulator assembly.

While the degree of curvature may vary somewhat, the degree will typically range from about 30 to about 60° as measured from the axis that extends from that portion of the vapor dip tube that does not curve to the curve. The dimensions of the vapor dip tube may be any dimension for the disclosed purpose. Typically, the dimensions will vary depending upon the size of the pressurized source vessel. By way of example, typically, based on standard sized pressurized vessels (2.5 liters volume), the entire length of the vapor dip tube will range from about one inch to about five inches with the curved portion accounting for approximately 20 to 50% of this length. The width of the tube may also vary but will typically range from about 0.25 inches to about 0.75 inches.

Those of ordinary skill in the art will recognize that while the vapor dip tube is present in order to serve as a safety measure to prevent the leakage of fluid into the integrated valve regulator assembly and therefore the possible leakage of fluid from the system, the vapor dip tube may also be used in embodiments where the hazardous material is in gas form alone.

The present invention, regardless of embodiment, may further comprise any number of additional components such as a cap to further secure the integrated valve regulator assembly by completely covering during transport, or a filter just upstream of the pressure regulator to aid in removing any debris that may be present before the gas is passed through the pressure regulator (sub-atmospheric or super-atmospheric). The filter will typically be a sintered metal element that is stainless steel, nickel, monel or like materials with a pore size equivalent from about 10 to about 200 μm, preferably from about 10 μm to about 50 μm.

For a further understanding of the nature and objects of the present invention, reference is made to the detailed description, taken in conjunction with the accompanying figures, in which like elements are given the same or analogous reference numbers.

The present invention provides for an integrated valve regulator assembly (1) that is used with a pressurized source vessel (2) in order to supply hazardous materials to one or more downstream systems. FIG. 1 provides a cut away of a pressurized source vessel (2) which depicts the interior space (3) for holding the hazardous material in either a compressed gas phase or a liquefied gas (plus vapor) phase as well as a neck portion (4) which allows for the attachment of the integrated valve regulator assembly (1) to the pressurized source vessel (2). The neck portion (4) has a vessel outlet (5) that traverses the neck portion (4) and serves as the path for the exit of the hazardous material from the pressurized source vessel (2) when the system is in use.

Figure 2:
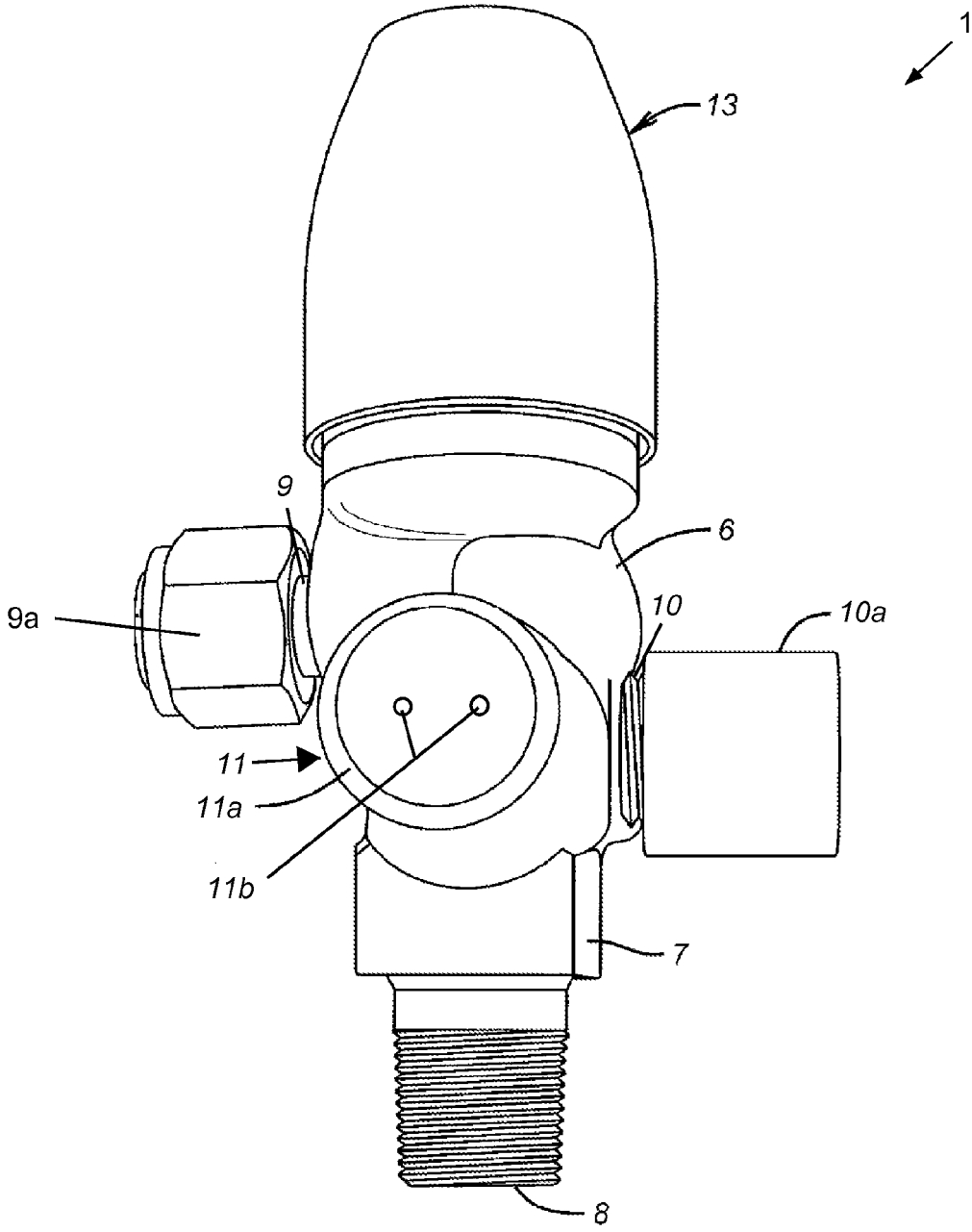
FIG. 2 provides a front view of the exterior of one embodiment of the integrated valve regulator assembly of the present invention.

FIG. 2 provides a front view of the exterior of the integrated valve regulator assembly (1) of the present invention. In this view, it can be seen that the integrated valve regulator assembly (1) comprises an integral body (6) that has a base portion (7) that includes an axis for mounting on and coaxially with the neck portion (not shown in FIG. 1) of the pressurized source vessel (2). The integral body (6) also includes an assembly inlet (8) for receiving the hazardous material from the pressurized source vessel (2) and consequently the entry of the hazardous materials into the integral body (6) of the integrated valve regulator assembly (1). FIG. 2 also shows the filling port (10) which includes a site of injection (not shown) that allows for the direct injection of hazardous material into the pressurized source vessel (2) by way of the integrated valve regulator assembly (1) when the associated filling valve (11) is in the opened position. When the filling port (10) is not in use, the associated filling valve (11) will be in the closed position (not shown). The assembly outlet (9) is also shown.

Figure 3:
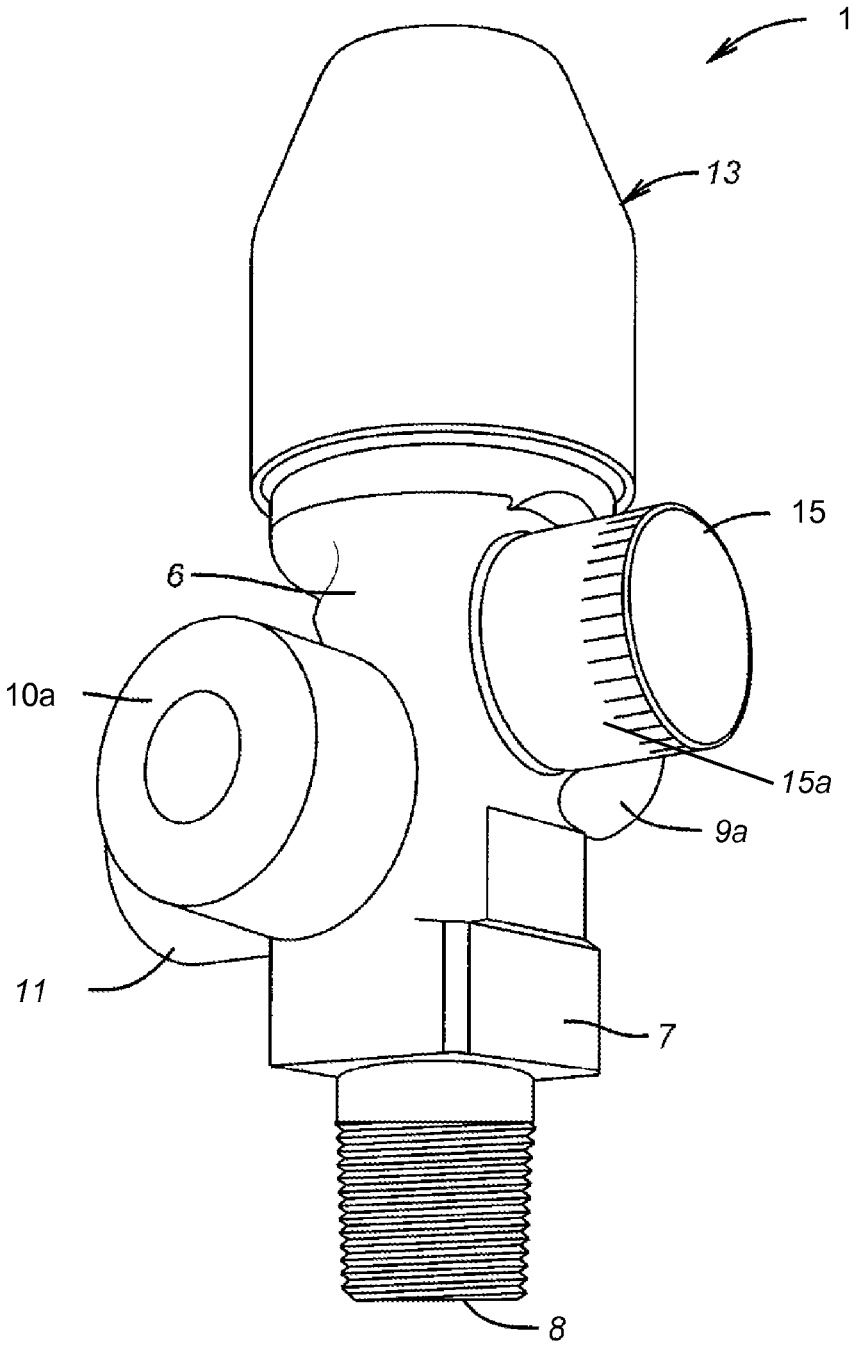
FIG. 3 provides an alternative side view of the exterior of one embodiment of the integrated valve regulator assembly of the present invention.

FIG. 3 provides an alternative side view of the exterior of one embodiment of the integrated valve regulator assembly (1) of the present invention. This figure clearly depicts the isolation valve (15) which allows for the exit of the hazardous materials from the integrated valve regulator assembly (1) when the isolation valve (15) is open and a source of vacuum is attached to the assembly outlet (9) where the hazardous material will be further directed to one or more downstream systems for use.

Figure 4A:
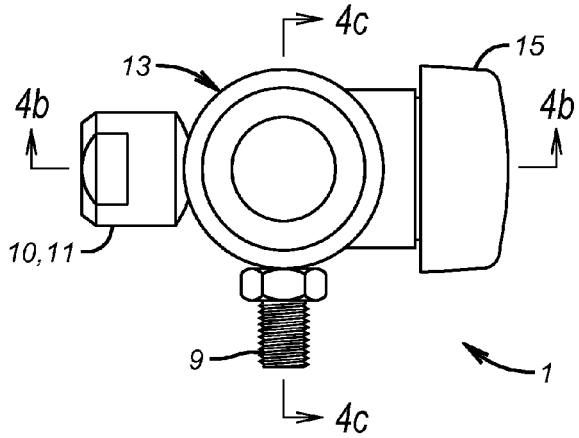
FIGS. 4*a*, 4*b* and 4*c* provide a top view of the integrated value regulatory assembly of the present invention and two different cut-away perspectives (front and side views) of an alternative embodiment of the integrated valve regulator assembly of the present invention.
Figure 4B:
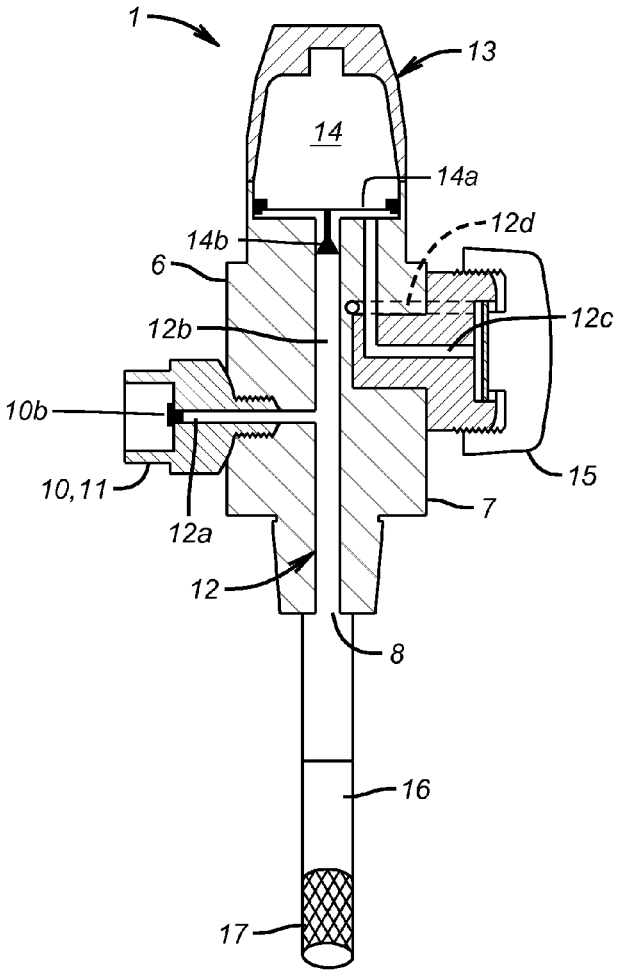
Figure 4C:
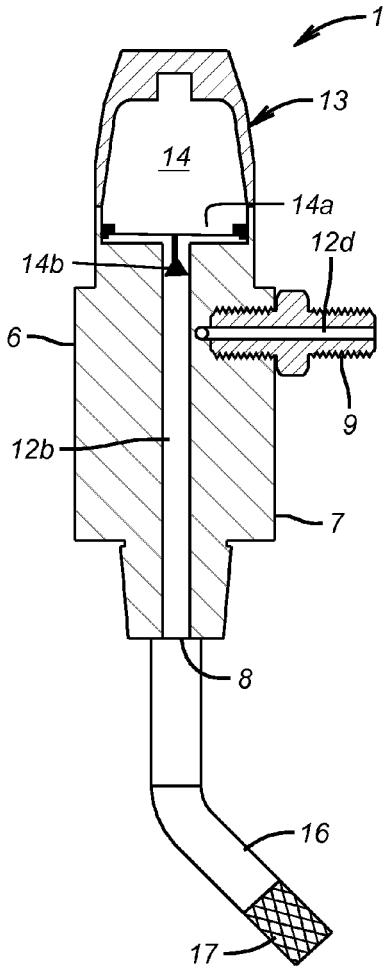

FIGS. 4*a*, 4*b* and 4*c* provide a more detailed depiction of the integrated valve regulator assembly (1) by providing a top view 4*a* of the integrated valve regulator assembly (1) of the present invention and two cut-away perspectives (front view 4*b* and side view 4*c*) of the integrated valve regulator assembly (1) of the present invention. As shown in these figures, the integral body (6) has a defined internal passage (12) that consists of a single continuous passageway (12, 12*b*, 12*c* and 12*d*) that extends through and between the base portion (7) of the integral body (6) and the assembly outlet (9). The defined internal passage (12) has an upstream portion that is in communication with the vessel outlet (5) of the pressurized source vessel (2). This upstream portion comprises in part the assembly inlet (8) of the integrated valve regulator assembly (1). Along this defined internal passage (12) there is disposed a pressure regulator (13) that may be either a sub-atmospheric pressure regulator or a super-atmospheric pressure regulator depending in part upon the hazardous materials to be dispensed and the downstream systems to be served. As noted hereinbefore, the pressure regulator (13) is assembled within the integral body (6) of the integrated valve regulator assembly (1) with the internal passage (12) of the integral body (6) forming the housing of the pressure regulator (13) within which a means for providing pressure (14)(sub-atmospheric or super-atmospheric) is disposed. The pressure regulator (13) allows for the passage of hazardous material in gas form when the means for providing pressure (14) senses a sub-atmospheric or super-atmospheric (depending upon the pressure regulator utilized) pressure downstream of the pressure regulator (13). As can be further seen from FIG. 4, the filling port and associated valve (10, 11) empties directly into the internal passage (12) between the assembly inlet (8) and the pressure regulator (13) thereby allowing for the injection of the hazardous materials directly into the internal passage (12) via the injection site (12*a*) where it will flow into the interior space (3) of the pressurized source vessel (2) when the associated filling valve (11) is open (the reverse route from when the hazardous materials are being dispensed to downstream systems). Downstream from the pressure regulator (13) an isolation valve (15) is positioned within the defined internal passage (12) of the integral body (6) of the integrated valve regulator assembly (1). The isolation valve (15) is in communication with the pressure regulator (13) through the internal passage (12*c*). The isolation valve (15) allows for the flow of hazardous material in gas form from the pressure regulator (13) through the isolation valve (15) along the internal passage (12*c*) when the isolation valve is in an opened position and blocks the flow of hazardous material in the gas form when the isolation valve (15) is in a closed position. For sub-atmospheric pressure regulators, in order for the flow of hazardous material to occur, the isolation valve (15) must not only be open, but a downstream system which provides a pressure of less than one atmosphere must be applied to (connected to and in communication with) the assembly outlet (9). This downstream system, along with the amount of pressure in the pressurized source vessel (2) determines at what point the means for providing pressure (14) opens up and allows the hazardous material to flow from the interior space (3) of the pressurized source vessel (2), through the vessel outlet (5) of the neck portion (4) where it then flows into the assembly inlet (8) of the integral body (6) of the integrated valve regulator assembly (1). The hazardous material, after entering the assembly inlet (8) flows along the internal passage (12, 12*b*) where it then enters the pressure regulator (13) and passes through the means for providing pressure (14) before passing further along the internal passage (12*c*) and through the isolation valve (15). The isolation valve (15) is located downstream from the pressure regulator (13) and is in communication with the assembly outlet (9). The hazardous material passes along the internal passage (12*c*) and through the isolation valve (15). The hazardous material then passes along the remaining portion of the internal passage (12*d*) before passing through the assembly outlet (9). A means for further distributing the hazardous material via a manifold or such will be connected to the assembly outlet (9) for further distribution of the hazardous materials when a downstream system having a pressure less than one atmosphere (in the case of the sub-atmospheric pressure regulator). In the case of super-atmospheric pressure regulators, the system allows for greater than one atmosphere along the internal passage (12*d*) through the assembly outlet (9).

Figure 5:
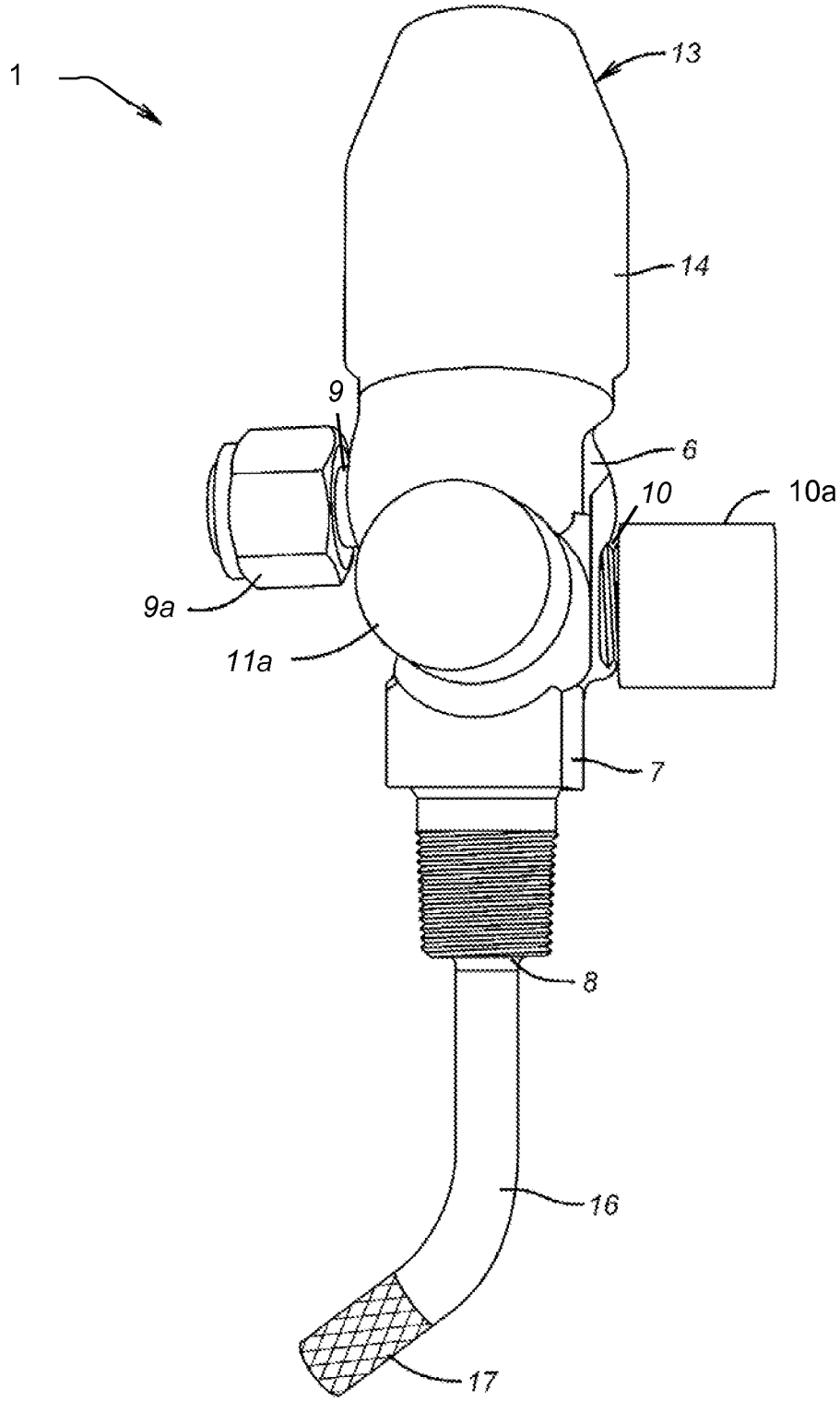
FIG. 5 provides a front view of an alternative embodiment of the integrated valve regulator assembly of the present invention which includes a dip tube.

An even further embodiment of the present invention is shown in FIG. 5 which provides a front view of an alternative embodiment of the integrated valve regulator assembly (1) of the present invention. In this particular embodiment, the internal passage (12) is connected to a vapor inlet dip tube (16) with a fritted end (17) in order to further prevent the leakage of any hazardous material from the pressurized source vessel (2) when and if the pressurized source vessel (2) is knocked over or placed on its side. The vapor dip tube (16) is configured to extend from the upstream portion of the defined internal passage (12) into the interior space (3) of the pressurized source vessel (2) when the base portion (7) of the integral body is mounted on and coaxially with the neck portion (4) of the pressurized source vessel (2), thereby allowing communication between the defined internal passage (12) and the interior space (3) of the pressurized source vessel (2) while at the same time preventing hazardous material in liquefied gas form from exiting the pressurized source vessel (2).

Figure 6:
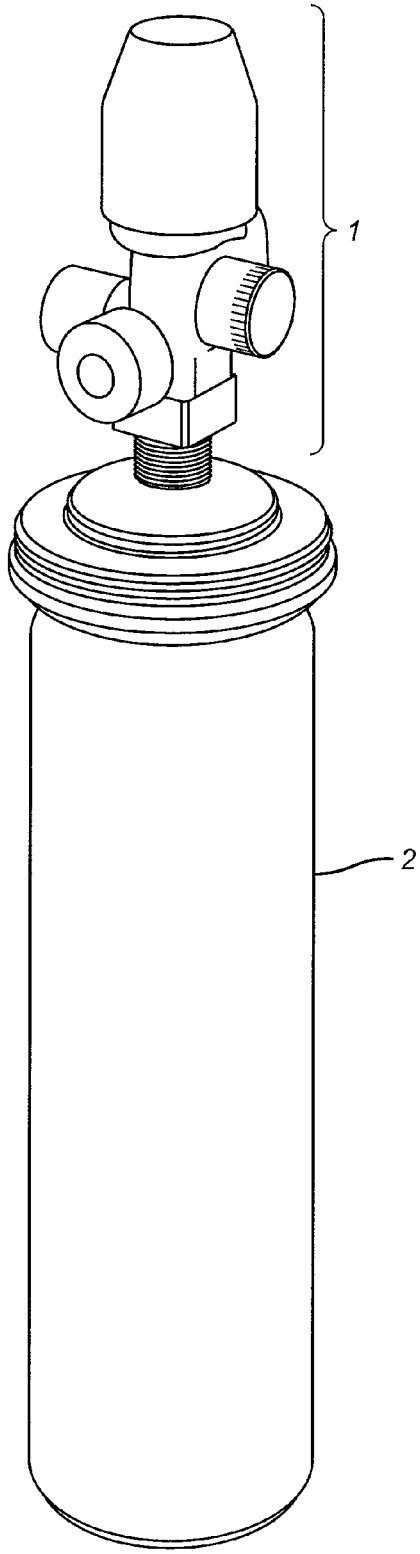
FIG. 6 provides a view of the gas delivery device attached to a pressurized source vessel.

The final FIG. 6 provides a view of the gas delivery device (1) attached to a pressurized source vessel (2).

While embodiments of this invention have been shown and described, modifications thereof can be made by one skilled in the art without departing from the spirit or teaching of this invention. The embodiments described herein are exemplary only and not limiting. Many variations and modifications of the composition and method are possible and within the scope of the invention. Accordingly the scope of protection is not limited to the embodiments described herein, but is only limited by the claims which follow, the scope of which shall include all equivalents of the subject matter of the claims.

LIST OF ELEMENTS IN FIGURES

1—integrated valve regulator assembly
2—pressurized source vessel
3—interior space of pressurized source vessel
4—neck portion of pressurized source vessel
5—vessel outlet of the pressurized source vessel
6—integral body of integrated valve regulator assembly
7—base portion of integrated valve regulator assembly
8—assembly inlet for integrated valve regulator assembly
9—assembly outlet of integrated valve regulator assembly
10—filling port of integrated valve regulator assembly
11—associated filling valve of integrated valve regulator assembly
12—defined internal passage of integrated valve regulator assembly
13—pressure regulator of integrated valve regulator assembly
14—means for providing pressure of integrated valve regulator assembly
15—isolation valve of integrated valve regulator assembly
16—vapor dip tube of integrated valve regulator assembly
17—flitted end of vapor dip tube of integrated valve regulator assembly
9*a*—locking mechanism of assembly outlet of integrated valve regulator assembly
10*a*—safety cap of filling port of integrated valve regulator assembly
10*b*—safety plug of filling port of integrated valve regulator assembly
11*a*—locking mechanism of filling valve of integrated valve regulator assembly
11*b*—handwheel of filling valve of integrated valve regulator assembly
14*a*—diaphragm of integrated valve regulator assembly
14*b*—poppet of integrated valve regulator assembly
15*a*—handwheel of isolation valve of integrated valve regulator assembly

What is claimed is:

1. A system for the controlled storage and dispensing of a hazardous material at sub-atmospheric pressure from a pressurized source vessel, the system comprising:

a. a pressurized source vessel having a neck portion and an interior space for holding a hazardous material in either a fluid form or a gas form, the neck portion having a vessel outlet that traverses the neck portion and is in communication with the interior space through which the hazardous material can flow; and b. an integrated valve regulator assembly for the pressurized source vessel, the integrated valve regulator assembly comprising:

i. an integral body having a base portion that includes an axis for mounting on and coaxially with the neck portion of the pressurized source vessel and an assembly outlet, ii. a defined internal passage in the integral body that extends through and between the base portion of the integral body and the assembly outlet, the defined internal passage having an upstream portion in communication with the vessel outlet of the pressurized source vessel, iii. a sub-atmospheric pressure regulator assembled within the integral body of the integrated valve regulator assembly, the integral body forming the housing of the regulator within which a means for providing sub-atmospheric pressure is disposed, the means for providing sub-atmospheric pressure comprising a poppet and a diaphragm which respond to pressure above a certain point by remaining closed, but which respond to pressure below a certain point by opening and allowing hazardous material to flow therethrough, the sub-atmospheric pressure regulator allowing for the passage of hazardous material in gas form when the means for providing sub-atmospheric pressure senses a sub-atmospheric pressure downstream of the sub-atmospheric pressure regulator, iv. an isolation valve positioned within the defined internal passage of the integral body of the integrated valve regulator assembly and located downstream from and in communication with the sub-atmospheric pressure regulator, the isolation valve allowing for the flow of hazardous material in gas form from the sub-atmospheric pressure regulator through the isolation valve when the isolation valve is in an opened position and blocking the flow of hazardous material in the gas form when the isolation valve is in a closed position, the isolation valve being further connected downstream to the assembly outlet, and v. a filling port disposed between the axis for mounting on and coaxially with the neck portion of the pressurized source vessel and the sub-atmospheric pressure regulator, the filling port having a site of injection that allows for the direct injection of hazardous material into the defined internal passage of the integral body and an associated filling valve having an opened and closed position and allowing for the injection of hazardous material into the pressurized source vessel through the injection site of the filling port when the filling valve is in the opened position, the filling port further comprising a safety plug that is positioned within the site of injection of the filling port and a safety cap that is positioned on the filling port which each require removal prior to the filling valve being opened to allow for the injection of hazardous material into the pressurized source vessel for storage of the hazardous material and replacement once the filling valve is closed in order to secure the filling port, wherein when a downstream system having a pressure less than one atmosphere is connected to the system via the assembly outlet and the isolation valve is in the opened position, hazardous material in gas form flows from the interior space of the pressurized source vessel through the vessel outlet, along the defined internal passage, through the sub-atmospheric pressure regulator and isolation valve and out the assembly outlet where the hazardous material in gas form is delivered to the point of use at sub-atmospheric pressure and wherein a flow point of the sub-atmospheric pressure regulator can vary depending upon the pressure in the source vessel and the pressure applied to the system via the assembly outlet, said flow point ranging from 50 Torr to 600 Torr.

2. The system of claim 1, wherein the hazardous materials are selected from $PH_3$, $BF_3$ and $AsH_3$.

3. The system of claim 1, wherein the hazardous material is $PH_3$ or $AsH_3$.

4. The system of claim 3, wherein the upstream portion of the single defined internal passage is connected to a vapor dip tube with a fritted end, the vapor dip tube configured to extend from the upstream portion of the defined internal passage into the interior space of the pressurized source vessel when the base portion of the integral body is mounted on and coaxially with the neck portion of the pressurized source vessel, thereby allowing communication between the defined internal passage and the interior space of the pressurized source vessel while at the same time preventing hazardous material in liquefied gas form from exiting the pressurized source vessel.

5. The system of claim 4, wherein the fritted end of the vapor dip tube has a sintered metal element.

6. The system of claim 5, wherein the sintered metal element has a 10 to 200 μm pore size equivalent.

7. The system of claim 4, wherein the vapor dip tube is curved to point in the same direction as the assembly outlet.

8. The system of claim 7, wherein when the pressurized source vessel is in a horizontal position, the vapor dip tube is pointed up thereby preventing hazardous material in the liquefied gas form from flowing into the integrated valve regulator assembly.

9. The system of claim 1, wherein the filling valve includes a locking mechanism for when said filling valve is not in use.

10. The system of claim 9, wherein the filling valve is manually operated utilizing a handwheel.

11. The system of claim 1, wherein the assembly outlet includes a locking mechanism for when said assembly outlet is not connected to a vacuum system.

12. The system of claim 11, wherein the isolation valve is manually operated utilizing a handwheel.

13. The system of claim 1, wherein the system further comprises a filter just upstream of the sub-atmospheric pressure regulator.

14. A system for the controlled storage and dispensing of a hazardous material at sub-atmospheric pressure from a pressurized source vessel, the system comprising:

a. a pressurized source vessel having a neck portion and an interior space for holding a hazardous material in either a fluid form or a gas form, the neck portion having a vessel outlet that traverses the neck portion and is in communication with the interior space through which the hazardous material can flow; and b. an integrated valve regulator assembly for the pressurized source vessel, the integrated valve regulator assembly comprising:

i. an integral body having a base portion that includes an axis for mounting on and coaxially with the neck portion of the pressurized source vessel and an assembly outlet, ii. a defined internal passage in the integral body that extends through and between the base portion of the integral body and the assembly outlet, the defined internal passage having an upstream portion connected to a vapor inlet dip tube with a fritted end, the vapor inlet dip tube configured to extend from the upstream portion of the defined internal passage into the interior space of the pressurized source vessel when the base portion of the integral body is mounted on and coaxially with the neck portion of the pressurized source vessel, thereby allowing communication between the defined internal passage and the interior space of the pressurized source vessel while at the same time preventing hazardous material in liquefied gas form from exiting the pressurized source vessel, iii. a sub-atmospheric pressure regulator positioned within the integral body of the integrated valve regulator assembly, the integral body forming the housing of the sub-atmospheric pressure regulator within which a means for providing sub-atmospheric pressure is disposed, the means for providing sub-atmospheric pressure comprising a poppet and a diaphragm which respond to pressure above a certain point by remaining closed, but which respond to pressure below a certain point by opening and allowing hazardous material to flow therethrough the sub-atmospheric pressure regulator allowing for the passage of hazardous material in gas form when the means for providing sub-atmospheric pressure senses a sub-atmospheric pressure downstream of the sub-atmospheric pressure regulator, iv. an isolation valve positioned within the defined internal passage of the integral body of the integrated valve regulator assembly and located downstream from and in communication with the sub-atmospheric pressure regulator, the isolation valve allowing for the flow of hazardous material in gas form from the sub-atmospheric pressure regulator through the isolation valve when the isolation valve is in an opened position and blocking the flow of hazardous material in the gas form when the isolation valve is in a closed position, the isolation valve being further connected downstream to the assembly outlet, and v. a filling port disposed between the vapor inlet dip tube and the sub-atmospheric pressure regulator, the filling port having a site of injection that allows for the direct injection of hazardous material into the defined internal passage of the integral body and an associated filling valve having an opened and closed position and allowing for the injection of hazardous material into the pressurized source vessel through the injection site of the filling port into the single defined internal passage where it flows through the vapor inlet dip tube and into the pressurized source vessel when the filling valve is in the opened position, the filling port further comprising a safety plug that is positioned within the site of injection of the filling port and a safety cap that is positioned on the filling port which each require removal prior to the filling valve being opened to allow for the injection of hazardous material into the pressurized source vessel for storage of the hazardous material and replacement once the filling valve is closed in order to secure the filling port, wherein when a downstream system having a pressure less than one atmosphere is connected to the system via the assembly outlet and the isolation valve is in the opened position, hazardous material in gas form flows from the interior space of the pressurized source vessel through the vapor dip tube, along the single defined internal passage, through the sub-atmospheric pressure regulator and isolation valve and out the assembly outlet where the hazardous material in gas form is delivered to the point of use at sub-atmospheric pressure, and wherein a flow point of the sub-atmospheric pressure regulator can vary depending upon the pressure in the source vessel and the pressure applied to the system via the assembly outlet, said flow point ranging from 50 Torr to 600 Torr.

15. An integrated valve regulator assembly for the controlled storage and dispensing of a hazardous material, the integrated valve regulator assembly comprising:

a. an integral body having a base portion that includes
   i) an axis that allows for the mounting on and coaxially with a neck portion of a pressurized source vessel; and
   ii) an assembly outlet, b. a defined internal passage in the integral body that extends through and between the base portion of the integral body and the assembly outlet, the defined internal passage having an upstream portion that allows for communication with a vessel outlet of a pressurized source vessel, c. a sub-atmospheric pressure regulator assembled within the integral body of the integrated valve regulator assembly, the integral body forming the housing of the regulator within which a means for providing sub-atmospheric pressure is disposed, the means for providing sub-atmospheric pressure comprising a poppet and a diaphragm which respond to pressure above a certain point by remaining closed, but which respond to pressure below a certain point by opening and allowing hazardous material to flow therethrough, the sub-atmospheric pressure regulator allowing for the passage of hazardous material in gas form when the means for providing sub-atmospheric pressure senses a sub-atmospheric pressure downstream of the sub-atmospheric pressure regulator, d. an isolation valve positioned within the defined internal passage of the integral body of the integrated valve regulator assembly and located downstream from and in communication with the sub-atmospheric pressure regulator, the isolation valve allowing for the flow of hazardous material in gas form from the sub-atmospheric pressure regulator through the isolation valve when the isolation valve is in an opened position and blocking the flow of hazardous material in the gas form when the isolation valve is in a closed position, the isolation valve being further connected downstream to the assembly outlet, and e. a filling port disposed between the axis and the sub-atmospheric pressure regulator, the filling port having a site of injection that allows for the direct injection of hazardous material into the defined internal passage of the integral body and an associated filling valve having an opened and closed position and allowing for the injection of hazardous material into the pressurized source vessel through the injection site of the filling port when the filling valve is in the opened position, the filling port further comprising a safety plug that is positioned within the site of injection of the filling port and a safety cap that is positioned on the filling port which each require removal prior to the filling valve being opened to allow for the injection of hazardous material into the pressurized source vessel for storage of the hazardous material and replacement once the filling valve is closed in order to secure the filling port, wherein when the assembly is connected to a pressurized source vessel containing hazardous materials and a downstream system having a pressure less than one atmosphere is connected to the assembly outlet and the isolation valve is in the opened position, hazardous material in gas form flows from the pressurized source vessel through the vessel outlet, along the defined internal passage, through the sub-atmospheric pressure regulator and isolation valve and out the assembly outlet where the hazardous material in gas form is delivered to a point of use at sub-atmospheric pressure and wherein a flow point of the sub-atmospheric pressure regulator can vary depending upon the pressure in the source vessel and the pressure applied to the system via the assembly outlet, said flow point ranging from 50 Torr to 600 Torr.

16. The assembly of claim 15, wherein the assembly further comprises a vapor dip tube with a fritted end upstream portion of the defined internal passage, the vapor dip tube configured to extend from the upstream portion of the defined internal passage into an interior space of a pressurized source vessel when the base portion of the integral body is mounted on and coaxially with a pressurized source vessel, thereby allowing communication between the defined internal passage and the interior space of the pressurized source vessel while at the same time preventing hazardous material in liquefied gas form from exiting the pressurized source vessel.

* * * * *